US010590738B2

(12) United States Patent
Sim et al.

(10) Patent No.: US 10,590,738 B2
(45) Date of Patent: Mar. 17, 2020

(54) RESETTABLE SLIDING SLEEVE FOR DOWNHOLE FLOW CONTROL ASSEMBLIES

(71) Applicant: Halliburton Energy Services, Inc., Houston, TX (US)

(72) Inventors: Nicholas Kok Jun Sim, Singapore (SG); Daniel Lorng Yon Wong, Singapore (SG); Adam Evan Beck, Flower Mound, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 246 days.

(21) Appl. No.: 15/542,068

(22) PCT Filed: Sep. 14, 2016

(86) PCT No.: PCT/US2016/051629

§ 371 (c)(1),
(2) Date: Jul. 6, 2017

(87) PCT Pub. No.: WO2018/052406

PCT Pub. Date: Mar. 22, 2018

(65) Prior Publication Data

US 2018/0274330 A1 Sep. 27, 2018

(51) Int. Cl.
*E21B 34/06* (2006.01)
*E21B 34/10* (2006.01)
(Continued)

(52) U.S. Cl.
CPC ..... *E21B 34/102* (2013.01); *E21B 23/04* (2013.01); *E21B 34/10* (2013.01); *E21B 34/16* (2013.01);
(Continued)

(58) Field of Classification Search
CPC ..... E21B 2034/007; E21B 34/06
See application file for complete search history.

(56) References Cited

U.S. PATENT DOCUMENTS 4,813,486 A 3/1989 Wyatt et al.
4,830,103 A 5/1989 Blackwell et al.
(Continued)

FOREIGN PATENT DOCUMENTS

WO 1997036089 A1 10/1997
WO 2014035383 A1 3/2014
WO 2016050301 A1 4/2016

OTHER PUBLICATIONS

International Search Report and Written Opinion for PCT/US2016/051629 dated Jun. 15, 2017.

*Primary Examiner* — Catherine Loikith
(74) *Attorney, Agent, or Firm* — McGuireWoods, LLP

(57) ABSTRACT

A flow control assembly includes a housing defining flow port that place an interior of the housing in fluid communication with an exterior of the housing, and a sliding sleeve defining sleeve ports and movably positioned within the interior between a first position, where fluid communication between the interior and the exterior via the flow ports is prevented, and a second positon, where fluid communication between the interior and the exterior is facilitated through the sleeve ports and the flow ports. A piston and a slip device are movably arranged within a piston chamber defined between the housing and the sliding sleeve. The piston has a first end exposed to an interior pressure and a second end exposed to an exterior pressure via chamber ports defined in the housing. A biasing device is also positioned within the piston chamber.

20 Claims, 3 Drawing Sheets

(51) Int. Cl.

| | |
|---|---|
| ***E21B 43/26*** | (2006.01) |
| ***E21B 43/14*** | (2006.01) |
| ***E21B 23/04*** | (2006.01) |
| ***E21B 43/12*** | (2006.01) |
| ***E21B 34/16*** | (2006.01) |
| *E21B 34/00* | (2006.01) |

(52) U.S. Cl.
CPC ..... *E21B 43/12* (2013.01); *E21B 43/14* (2013.01); *E21B 43/26* (2013.01); *E21B 2034/007* (2013.01)

(56) References Cited

U.S. PATENT DOCUMENTS

| | | | |
|---|---|---|---|
| 2002/0157837 | A1 | 10/2002 | Bode et al. |
| 2013/0269928 | A1 | 10/2013 | Zhou |
| 2014/0083708 | A1 | 3/2014 | Beck et al. |
| 2015/0233210 | A1 | 8/2015 | Beck et al. |

RESETTABLE SLIDING SLEEVE FOR DOWNHOLE FLOW CONTROL ASSEMBLIES

BACKGROUND

Hydrocarbon-producing wells are often stimulated by undertaking one or more hydraulic fracturing operations, which generally include injecting a fracturing fluid into a subterranean formation penetrated by a wellbore at pressures sufficient to create or enhance at least one fracture therein. One of the purposes of the fracturing process is to increase formation conductivity so that the greatest possible quantity of hydrocarbons from the formation can be extracted/produced into the penetrating wellbore.

In some wells, fractures are selectively created along the wellbore at predetermined separation distances to generate "pay zones" from which hydrocarbons can be intelligently produced into a downhole completion assembly arranged in the wellbore. The completion assembly is operatively coupled to production tubing, which provides a conduit to convey produced hydrocarbons to the well surface for collection. A series of actuatable flow control assemblies are typically included in the downhole completion assembly to separate or isolate the various pay zones for intelligent production. Such flow control assemblies frequently include movable isolation devices, such as sliding sleeves or sliding side doors. Axially shifting these isolation devices allows a well operator to regulate hydrocarbon production through the flow control assembly and into the production tubing at that particular location. Actuating an isolation device in one axial direction, for instance, exposes one or more flow ports that facilitate the influx of fluids into the production tubing. Actuating the isolation device in the opposing axial direction occludes the flow ports and thereby stops the influx of fluids.

In other downhole applications, similar movable isolation devices can alternatively be used as a circulating sleeve above wellbore packer. Such applications include use in a conventional well without hydraulic fracturing.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to equipment used in subterranean well operations and, more particularly, to flow control assemblies used in a subterranean well completion and having a remotely resettable sliding sleeve.

The embodiments disclosed herein describe a flow control assembly that is actuatable to allow and prevent fluid communication into the interior of the flow control assembly. The flow control assembly includes a housing defining one or more flow ports that place the interior of the housing in fluid communication with a wellbore annulus. A sliding sleeve defining one or more sleeve ports is movably positioned within the interior between a first position, where fluid communication between the interior and the wellbore annulus via the flow ports is prevented, and a second position, where the sleeve ports are at least partially aligned with the flow ports to facilitate fluid communication between the interior and the wellbore annulus. A piston and a slip device are arranged within a piston chamber defined between the housing and the sliding sleeve, and the piston has a first end exposed to an interior pressure and a second end exposed to the annulus pressure via one or more chamber ports defined in the housing.

Increasing an annulus pressure within the wellbore annulus moves the piston and the slip device relative to the sliding sleeve in a first direction within the piston chamber, and a biasing device positioned in the piston chamber is compressed as the piston and the slip device move in the first direction. The biasing device may then be allowed to expand and move the piston and the slip device in a second direction within the piston chamber. This may be accomplished by overcoming the annulus pressure, which can be done by reducing the annulus pressure or alternatively by increasing the pressure within the flow control assembly (i.e., within the base pipe supporting the flow control assembly). As the piston and the slip device move in the second direction, the slip device engages the sliding sleeve and thereby moves the sliding sleeve toward the second position. When it is desired to close the flow control assembly, a shifting tool can be extended into the housing to engage an inner profile defined on the sliding sleeve. The shifting tool can then move the sliding sleeve back to the first position. Accordingly, the flow control assembly is infinitely resettable, and half of the operations are remotely actuated by pressurizing the wellbore annulus and overcoming the annulus pressure. This may prove advantageous in halving of the typical intervention trips required to open and close conventional flow control assemblies.

Figure 1:
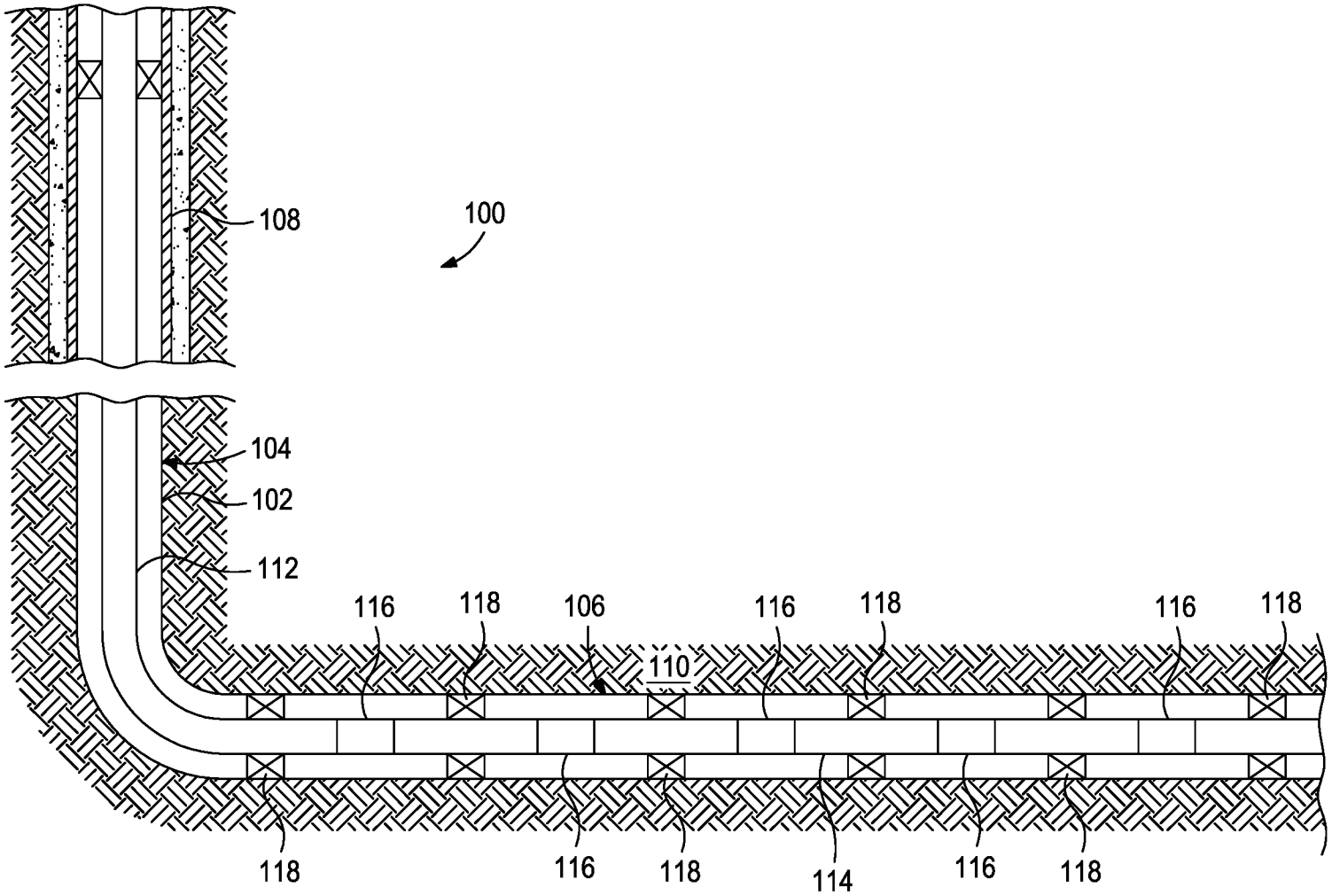
FIG. 1 is a well system that may employ the principles of the present disclosure.

FIG. 1 is a well system 100 that may employ the principles of the present disclosure, according to one or more embodiments. As depicted, the well system 100 includes a wellbore 102 that extends through various earth strata and has a substantially vertical section 104 that transitions into a substantially horizontal section 106. The upper portion of the vertical section 104 may have a string of casing 108 cemented therein, and the horizontal section 106 may extend through a hydrocarbon bearing subterranean formation 110. In at least one embodiment, the horizontal section 106 may comprise an open hole section of the wellbore 102. In other embodiments, however, the casing 108 may extend into the horizontal section 106.

A string of pipe or production tubing 112 may be positioned within the wellbore 102 and extend from a well surface (not shown), such as a production rig, a production platform, or the like. In some cases, the production tubing 112 may comprise a string of multiple pipes coupled end to end and extended into the wellbore 102. In other cases, the production tubing 112 may comprise a continuous length of tubing, such as coiled tubing or the like. At its lower end, the production tubing 112 may be coupled to and otherwise form part of a downhole completion 114 arranged within the horizontal section 106. The downhole completion 114 serves to divide wellbore 102 into various production intervals (alternately referred to as "pay zones") adjacent the formation 110. During production operations, the production tubing 112 provides a conduit for fluids extracted from the surrounding formation 110 to travel to the well surface.

As depicted, the downhole completion 114 may include a plurality of flow control assemblies 116 axially offset from each other along portions of the downhole completion 114. In some applications, each flow control assembly 116 may be positioned between a pair of packers 118 that provides a fluid seal between the downhole completion 114 and the wellbore 102, and thereby defining corresponding production intervals along the length of the downhole completion 114. Each flow control assembly 116 may operate to selectively regulate fluid flow into the production tubing 112 from the surrounding formation 110.

It should be noted that even though FIG. 1 depicts the flow control assemblies 116 as being arranged in an open hole portion of the wellbore 102, embodiments are contemplated herein where one or more of the flow control assemblies 116 is arranged within cased portions of the wellbore 102. Also, even though FIG. 1 depicts a single flow control assembly 116 arranged in each production interval, any number of flow control assemblies 116 might be deployed within a particular interval without departing from the scope of the disclosure. In addition, even though FIG. 1 depicts multiple intervals separated by the packers 118, it will be understood by those skilled in the art that the completion interval may include any number of intervals with a corresponding number of packers 118 arranged therein. In other embodiments, the packers 118 may be entirely omitted from the completion interval, without departing from the scope of the disclosure.

While FIG. 1 depicts the flow control assemblies 116 as being arranged in the horizontal section 106 of the wellbore 102, those skilled in the art will readily recognize that the flow control assemblies 116 are equally well suited for use in wells having other directional configurations including vertical wells, deviated wellbores, slanted wells, multilateral wells, combinations thereof, and the like. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
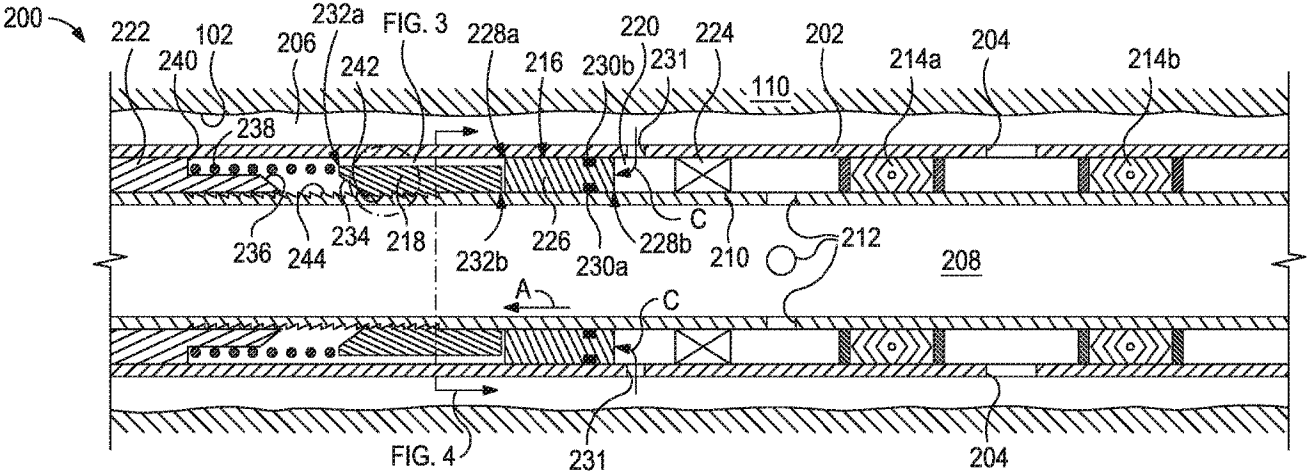
FIG. 2 is a cross-sectional side view of an exemplary flow control assembly.

FIG. 2 is a cross-sectional side view of an exemplary flow control assembly 200, according to one or more embodiments. The flow control assembly 200 (hereafter "the assembly 200") may be the same as or similar to any of the flow control assemblies 116 of FIG. 1. Accordingly, the assembly 200 may be deployed in the wellbore 102 adjacent the subterranean formation 110 and may be operatively coupled to the production tubing 112 (FIG. 1) in the downhole completion 114 (FIG. 1). As illustrated, the assembly 200 is depicted as being arranged in an open hole section of the wellbore 102, but those skilled in the art will readily appreciate that the assembly 200 may equally be deployed in a cased section of the wellbore 102, without departing from the scope of the disclosure.

Figure 7:
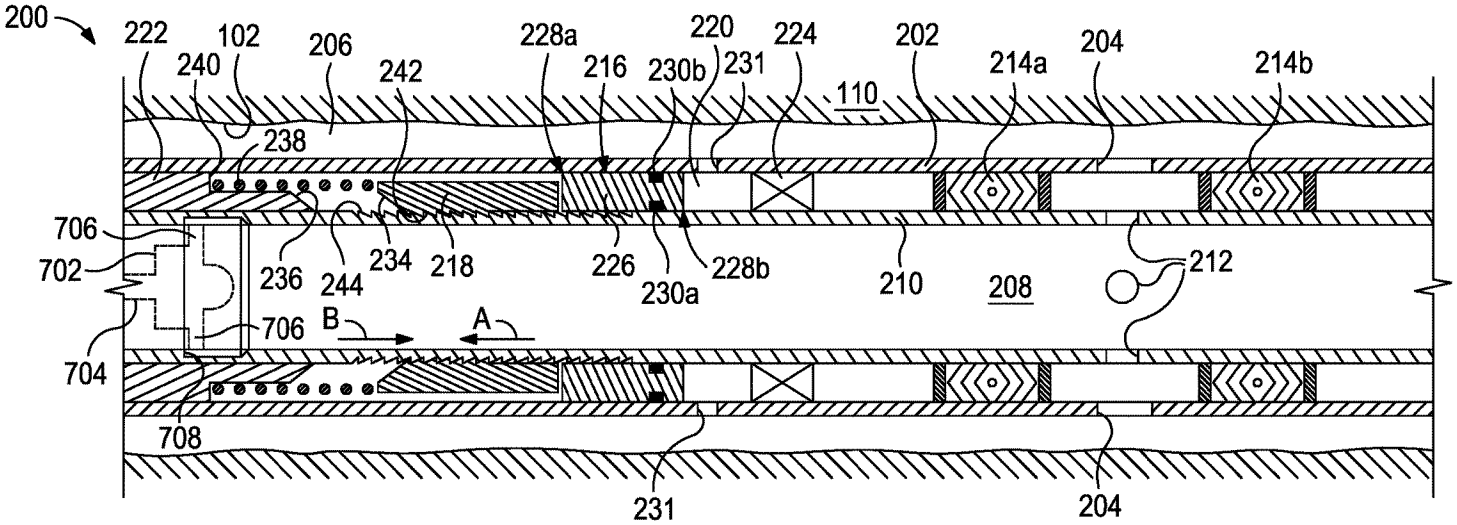

The assembly 200 may include an elongate housing 202 that defines one or more flow ports 204 (two shown), which provide fluid communication between a wellbore annulus 206 and an interior 208 of the housing 202 when the assembly 200 is in an open configuration. The assembly 200 may further include a sliding sleeve 210 positioned within the interior 208 and defining one or more sleeve ports 212 (three shown). The sliding sleeve 210 may be axially movable relative to the housing 202 between a first position, as shown in FIG. 2, and a second positon, as shown in FIG. 7. In the first position, the sliding sleeve 210 generally occludes the flow ports 204 and thereby prevents fluid communication between the wellbore annulus 206 and the interior 208 of the housing 202. In the second position, the sliding sleeve 210 moves axially to at least partially align the sleeve ports 212 and the flow ports 204 and thereby allow fluid communication between the wellbore annulus 206 and the interior 208.

The housing 202 defining one or more chamber ports 231 that place an outer interior of the housing between the housing 202 and the sliding sleeve 210 in fluid communication with the wellbore annulus 206 and one or more flow ports 204 that place an inner interior of the housing within the interior 208 in fluid communication with a the wellbore annulus 206.

The assembly 200 may further include a first or upper dynamic seal 214*a* and a second or lower dynamic seal 214*b* that interposes the housing 202 and the sliding sleeve 210 and are positioned on opposing axial ends of the flow ports 204. As used herein, the term "dynamic seal" is used to indicate a seal that provides pressure and/or fluid isolation between members that have relative displacement therebetween, for example, a seal that seals against a displacing surface, or a seal carried on one member and sealing against the other member. The first and second dynamic seals 214*a,b* are configured to "dynamically" seal against the outer surface of the sliding sleeve 210 as it axially translates relative to the housing 202 between the first and second positions. When the sliding sleeve 210 is stationary, the first and second dynamic seals 214*a,b* provide fluid isolation between the housing 202 and the sliding sleeve 210 and thereby prevent fluid migration in either axial direction at the corresponding sealed interfaces.

The first and second dynamic seals 214*a,b* may be made of a variety of materials including, but not limited to, an elastomeric material, a metal, a composite, a rubber, a ceramic, any derivative thereof, and any combination thereof. In some embodiments, the first and second dynamic seals 214*a,b* may comprise one or more O-rings or the like. In other embodiments, however, the first and second dynamic seals 214*a,b* may comprise a set of v-rings or CHEVRON® packing rings, or another appropriate seal configuration (e.g., seals that are round, v-shaped, u-shaped, square, oval, t-shaped, etc.), as generally known to those skilled in the art.

The assembly 200 may further include a piston 216 and a slip device 218 movably arranged within a piston chamber 220 defined radially between the housing 202 and the sliding sleeve 210. The piston chamber 220 is further defined axially between a wedge member 222 and a chamber seal 224. The chamber seal 224 may be similar to the dynamic seals 214*a,b* and used to dynamically seal against the outer surface of the sliding sleeve 210 as it axially translates relative to the housing 202 between the first and second positions. However, the chamber seal 224 may alternatively comprise any type of sealing device or element that substantially prevents fluid migration in either axial direction at the sealed interface.

The piston 216 includes an elongate body 226 having a first or uphole end 228*a* and a second or downhole end 228*b*.

At least two sealing elements 230*a* and 230*b* are carried by the piston 216 and provide corresponding inner and outer sealed interfaces within the piston chamber 220. More specifically, the inner sealing element 230*a* interposes the piston 216 and the outer radial surface of the sliding sleeve 210 and the outer sealing element 230*b* interposes the piston 216 and the inner radial surface of the housing 202. As the piston 216 translates axially within the piston chamber 220, the sealing elements 230*a,b* prevent fluid migration past the piston 216 in either axial direction.

The housing 202 defines one or more chamber ports 231 (two shown) that place the piston chamber 220 in fluid communication with the wellbore annulus 206. The piston 216 effectively divides the piston chamber 220 so that the second end 228*b* of the piston 216 is exposed to the fluid pressure present within the wellbore annulus 206 (referred to as "annulus pressure") via the chamber ports 231, and the first end 228*a* of the piston 216 is exposed to the fluid pressure present within the interior 208 of the housing 202 (referred to as "tubing pressure"). The sealing elements 230*a,b* carried by piston 216 and the chamber seal 224 prevent fluids from the wellbore annulus 206 from intermingling with fluids in the interior 208 via the piston chamber 220.

The slip device 218 axially interposes the piston 216 and the wedge member 222 within the piston chamber 220. The slip device 218 provides a first or uphole end 232*a* and a second or downhole end 232*b*. As illustrated, the slip device 218 provides a slip ramp 234 at the first end 232*a*. The slip ramp 234 may comprise an angled surface configured to slidingly engage an opposing wedge ramp 236 defined on the wedge member 222.

The wedge member 222 is fixed within the piston chamber 220 and provides the wedge ramp 236, which comprises an angled surface configured to receive the slip ramp 234 as the slip device 218 advances axially toward the wedge member 222. A biasing device 238 may be positioned within the piston chamber 220 and interpose the wedge member 222 and the slip device 218. The biasing device 238 may comprise any type of device or mechanism that urges the slip device 218 axially away from the wedge member 222. In some embodiments, as illustrated, the biasing device 238 may comprise a coil spring. In other embodiments, however, the biasing device 238 may comprise a series of Belleville washers, a hydraulic actuator, a pneumatic actuator, a wave spring, or any combination of the foregoing.

The biasing device 238 may be positioned to engage the first end 232*a* of the slip device 218 and an axial shoulder 240 defined on the wedge member 222. As the slip device 218 advances axially toward the wedge member 222, the biasing device 238 is compressed between the first end 232*a* of the slip device 218 and the axial shoulder 240 and progressively builds spring force.

Figure 3:
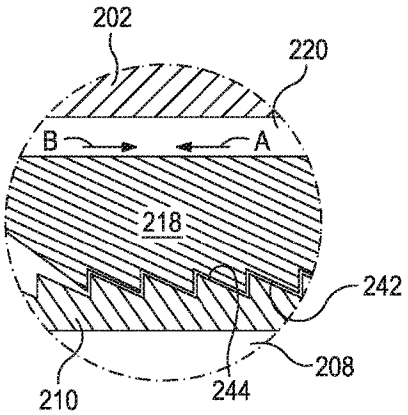
FIG. 3 is an enlarged, detail cross-sectional side view of the flow control assembly of FIG. 2, as indicated by the dashed area of FIG. 2.

FIG. 3 is an enlarged, detail cross-sectional side view of the assembly 200 as indicated by the dashed circle shown in FIG. 2. As illustrated, a series of slip teeth 242 may be defined on at least a portion of the inner radial surface of the slip ramp 218. The slip teeth 242 may be configured to engage a series of sleeve teeth 244 defined on the outer radial surface of the sliding sleeve 210. The opposing series of slip and sleeve teeth 242, 244 may be angled and otherwise profiled to allow the slip device 218 to move axially within the piston chamber 220 in a first or uphole direction A relative to the sliding sleeve 210, but prevent relative movement when the slip device 218 moves in a second or downhole direction B opposite the first direction A. More particularly, as the slip device 218 moves in the first direction A, the angled profiles of the opposing slip and sleeve teeth 242, 244 allow the slip teeth 242 to ratchet against (over) the sleeve teeth 244, which allows the slip device 218 to move relative to the sliding sleeve 210. When moving the slip device 218 in the second direction B, however, the angled profiles of the opposing slip and sleeve teeth 242, 244 engage opposing radial shoulders that prevent the slip teeth 242 from ratcheting over the sleeve teeth 244. Instead, when the slip device 218 is moved in the second direction B within the piston chamber 220, the sliding sleeve 210 will correspondingly move in the same direction within the interior of the housing 202.

The opposing series of slip and sleeve teeth 242, 244 operates similarly when the sliding sleeve 210 is moved relative to the slip device 218. More specifically, as the sliding sleeve 210 moves in the second direction B relative to the slip device 218, the angled profiles of the opposing slip and sleeve teeth 242, 244 allow the sleeve teeth 244 to ratchet against (over) the slip teeth 242, which allows the sliding sleeve 210 to move relative to the slip device 218. When moving the sliding sleeve 210 in the first direction A, however, the angled profiles of the opposing slip and sleeve teeth 242, 244 engage the opposing radial shoulders and prevent the sleeve teeth 244 from ratcheting over the slip teeth 218. Instead, when the sliding sleeve 210 is moved in the first direction A, the slip device 218 will correspondingly move in the same direction within the piston chamber 220.

Figure 4:
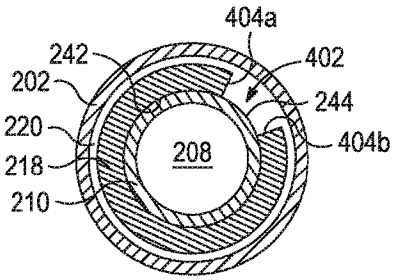
FIG. 4 is a cross-sectional end view of the flow control assembly of FIG. 2 taken along the lines 4-4 in FIG. 2.

FIG. 4 is a cross-sectional end view of the assembly 200 of FIG. 2 as taken along the lines 4-4 depicted in FIG. 2. More particularly, FIG. 4 depicts one example of the slip device 218 that can be used in the assembly 200. As illustrated, the slip device 218 may comprise a generally circular structure that provides a cut 402 so that the slip device 218 does not form a complete ring, but instead defines two opposing ring ends 404*a* and 404*b*. Accordingly, the slip device 218 may be characterized as a C-ring or similar device or structure. The slip device 218 may be made of an elastic material (e.g., spring steel or another elastic metal) capable of allowing the slip device 218 to radially expand from an initial diameter and elastically return to the initial diameter. Elasticity of the slip device 218 may prove advantageous since, as described below, the slip device 218 may be configured to expand radially outward upon engaging the wedge member 222 and, upon disengaging the wedge member 222, the slip device 218 may elastically contract back to the initial diameter.

Figure 5:
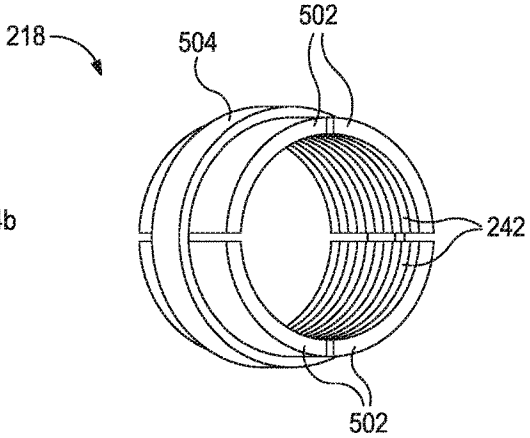
FIG. 5 is an isometric view of another exemplary embodiment of the slip device of FIG. 2.

FIG. 5 is an isometric view of another exemplary embodiment of the slip device 218. As illustrated, the slip device 218 may include a plurality of arcuate slip segments 502, and the slip teeth 242 are defined on the inner radial surface of each slip segment 502. It should be noted that while four slip segments 502 are shown, more or less than four may be employed in the slip device 218, without departing from the scope of the disclosure.

The slip device 218 of FIG. 5 may further include a retaining band 504 positioned about the outer periphery of the slip segments 502. The retaining band 504 may be used to help radially retain the slip segments 502 at an initial diameter and allow the slip segments 502 to radially expand from the initial diameter and elastically return to the initial diameter. Accordingly, the retaining band 504 may be made of a material having sufficient strength to hold the slip segments 502 at the initial diameter, flexible enough to allow the slip segments 502 to radially expand when needed, and elastic enough to allow the slip device 218 to contract back to the initial diameter.

Figure 6:
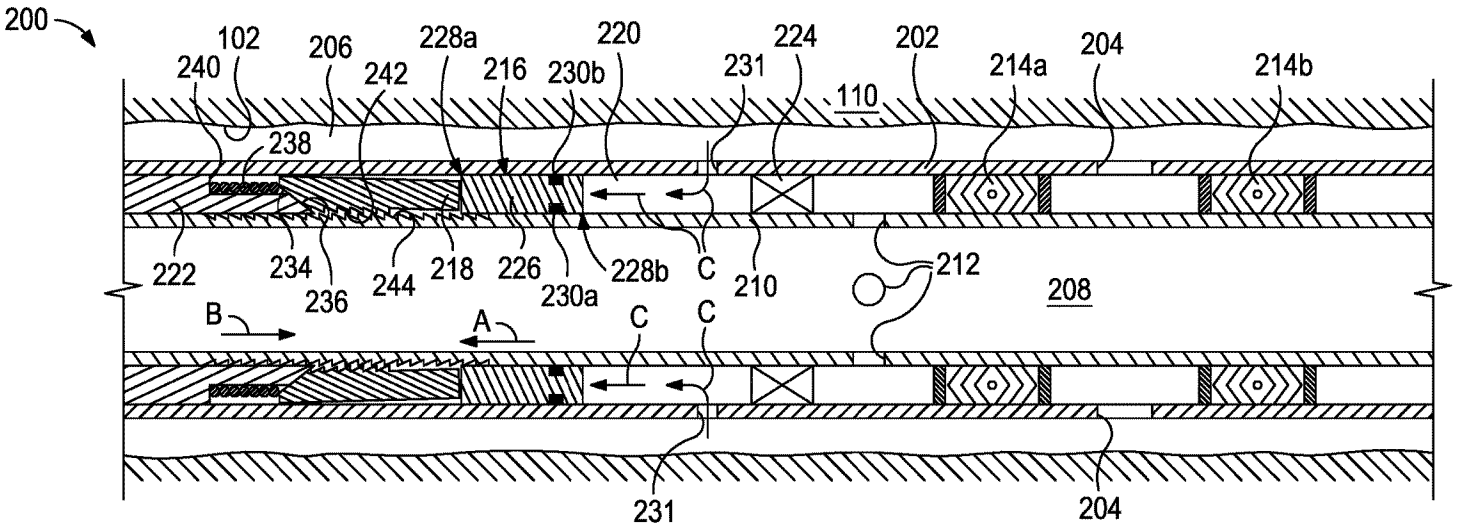
FIGS. 6 and 7 are progressive cross-sectional side views of the flow control assembly of FIG. 2 during exemplary operation.

FIGS. 6 and 7 are progressive cross-sectional side views of the assembly 200 of FIG. 2. With reference to FIGS. 2, 6, and 7, exemplary operation of the assembly 200 is now provided. As indicated above, the assembly 200 may be movable between a closed configuration, as shown in FIG. 2, and an open configuration, as shown in FIG. 7. When the assembly 200 is in the closed configuration, the sliding sleeve 210 is in the first position and generally occludes the flow ports 204 such that fluid communication between the wellbore annulus 206 and the interior 208 is prevented. When the assembly 200 is in the open configuration, however, the sliding sleeve 210 is in the second positon where the sleeve ports 212 and the flow ports 204 may be are at least partially aligned such that fluid communication between the wellbore annulus 206 and the interior 208 is facilitated. In at least one embodiment, the sleeve ports 212 and the flow ports 204 may be radially aligned when the sliding sleeve 210 is in the second position.

To move the assembly 200 to the open configuration, the pressure in the wellbore annulus 206 (referred to as "annulus pressure") may be increased while the pressure in the interior 208 (referred to as "tubing pressure") is maintained at an initial value. This may be accomplished by a well operator at the surface of the well. Since the second end 228*b* of the piston 216 is exposed to the annulus pressure via the chamber ports 231, increasing the annulus pressure correspondingly increases the pressure acting on the second end 228*b* of the piston 216, as indicated by the arrows C. As a result, a pressure differential may be generated across the piston 216, which forces the piston 216 to move axially within the piston chamber 220 in the first direction and toward the wedge member 222. As the piston 216 moves in the first direction A, the first end 228*a* of the piston 216 axially engages the second end 232*b* of the slip device 218 and correspondingly moves the slip device 218 in the first direction A within the piston chamber 220.

As discussed above, as the slip device 218 moves in the first direction A, the slip teeth 242 (FIG. 3) of the slip device 218 are able to ratchet against (over) the sleeve teeth 244 (FIG. 3), which allows the slip device 218 to move relative to the sliding sleeve 210. Moreover, as the slip device 218 moves axially in the first direction A, the biasing device 238 becomes progressively compressed between the first end 232*a* of the slip device 218 and the axial shoulder 240 defined on the wedge member 222.

In FIG. 6, the piston 216 and the slip device 218 advance toward the wedge member 222 until the slip ramp 234 extends over and slidingly engages the wedge ramp 236. Continued movement of the slip device 218 in the first direction A will force the slip device 218 to radially expand within the piston chamber 220 as the slip ramp 234 rides up the oppositely-angled wedge ramp 236. As the slip device 218 radially expands, the slip teeth 242 eventually become disengaged from the sleeve teeth 244. The piston 216 may continue its stroke under the force of the annulus pressure C to fully compress the biasing device 238. At this point the piston 216 and the slip device 218 stop moving within the piston chamber 220.

In FIG. 7, the sliding sleeve 210 is shown moved in the second direction B to the second position. The sliding sleeve 210 may be moved in the second direction B toward the second position by overcoming the pressure in the wellbore annulus 206. In some embodiments, this can be accomplished by reducing (e.g., bleeding) the pressure in the wellbore annulus 206, which correspondingly reduces the pressure acting on the second end 228*b* of the piston 216 via the chamber ports 231. In other embodiments, however, overcoming the pressure in the wellbore annulus 206 may be accomplished by increasing the pressure in the interior 208 (i.e., the tubing pressure), which correspondingly increases the pressure acting on the first end 228*a* of the piston 216. By overcoming the annulus pressure, the spring force accumulated in the biasing device 238 is able to release and act on the first end 232*a* of the slip device 218. As the biasing device 238 expands, the slip device 218 and the piston 216 are each moved in the second direction B within the piston chamber 220 and away from the wedge member 222.

Movement of the slip device 218 in the second direction B allows the slip device 218 to radially contract as the slip ramp 234 slidingly engages and rides down the wedge ramp 236. As the slip device 218 radially contracts, the slip teeth 242 once again engage the sleeve teeth 244 and the angled profiles of the opposing slip and sleeve teeth 242, 244 prevent the slip teeth 242 from ratcheting over the sleeve teeth 244. Instead, the slip teeth 242 engage the sleeve teeth 244 such that movement of the slip device 218 in the second direction B within the piston chamber 220 correspondingly moves the sliding sleeve 210 in the same direction within the interior of the housing 202. As the sliding sleeve 210 moves in the second direction B as carried by the slip device 218, the sleeve ports 212 eventually become aligned with the flow ports 204.

Depending on the stroke length of the piston 216 in the first direction A, the foregoing process may be repeated until the sleeve ports 212 become aligned with the flow ports 204 to facilitate fluid communication between the wellbore annulus 206 and the interior 208. A well operator may be able to ascertain when the sleeve ports 212 and the flow ports 204 are aligned for fluid communication by detecting a pressure increase within the interior 208, which is transmitted to the surface location via the interconnected production tubing 112 (FIG. 1). Alternatively, a well operator may be able to ascertain when the sleeve ports 212 and the flow ports 204 are aligned for fluid communication by knowing the stroke length of the piston 216 and the distance required for the sliding sleeve 210 to move to align the sleeve ports 212 and the flow ports 204.

To move the assembly 200 back to the closed configuration, and thereby stop fluid flow into the interior 208 from the wellbore annulus 206, the sliding sleeve 210 is moved back to the first position. To accomplish this, in at least one embodiment, a shifting tool 702 (shown in phantom in FIG. 7) may be introduced into the production tubing 112 (FIG. 1) and conveyed (e.g., pumped, pushed, allowed to fall under gravitational forces, etc.) to the assembly 200 on a conveyance 704. The conveyance 704 may comprise, for example, wireline, slickline, coiled tubing, or any other suitable conveyance.

In at least one embodiment, the shifting tool 702 may have one or more radial keys or arms 706 configured to extend radially from the shifting tool 702 and locate or otherwise engage a profile 708 defined on the sliding sleeve 210. In some embodiments, the radial arms 706 may be spring loaded. In other embodiments, however, the radial arms 706 may be mechanically, electromechanically, or hydraulically actuated. While the shifting tool 702 has been described herein as having a particular configuration, those skilled in the art will readily recognize that many variations of the shifting tool 702 may be used to engage and shift the sliding sleeve 210, without departing from the scope of the disclosure.

Once the shifting tool 702 locates and properly engages the profile 708 of the sliding sleeve 210, the shifting tool 702 may then be moved in the first direction A. In some embodiments, this may be accomplished by retracting (pulling) the conveyance 704 uphole. In other embodiments, the shifting tool 702 may alternatively be "jarred" in the first direction A, which entails an upward (uphole) impulse force applied to the shifting tool 702 using an attached jarring tool or device (not shown). As the sliding sleeve 210 moves in the first direction A, the angled profiles of the opposing slip and sleeve teeth 242, 244 become engaged and prevent the sleeve teeth 244 from ratcheting over the slip teeth 218. Instead, moving the sliding sleeve 210 in the first direction A will correspondingly move the slip device 218 in the same direction within the piston chamber 220.

As carried by engagement with the sliding sleeve 210, the slip device 218 will move in the first direction A until the slip device 218 axially engages the wedge member 222, at which point the slip ramp 234 slidingly engages the wedge ramp 236 to radially expand the slip device 218 within the piston chamber 220. As the slip device 218 radially expands, the slip teeth 242 become disengaged from the sleeve teeth 244 and the sliding sleeve 210 is then free to move relative to the slip device 218 back to the first position, where the assembly 200 is once again placed in the closed configuration.

Embodiments disclosed herein include:

A. A flow control assembly that includes a housing defining one or more flow ports that place an interior of the housing in fluid communication with an exterior of the housing, a sliding sleeve defining one or more sleeve ports and movably positioned within the interior between a first position, where fluid communication between the interior and the exterior via the one or more flow ports is prevented, and a second positon, where fluid communication between the interior and the exterior is facilitated through the one or more sleeve ports and the one or more flow ports, a piston movably arranged within a piston chamber defined between the housing and the sliding sleeve, the piston having a first end exposed to an interior pressure and a second end exposed to an exterior pressure via one or more chamber ports defined in the housing, a slip device movably arranged within the piston chamber, and a biasing device positioned within the piston chamber, wherein increasing the exterior pressure moves the piston and the slip device relative to the sliding sleeve in a first direction within the piston chamber to compress the biasing device, and wherein overcoming the exterior pressure allows the biasing device to expand and move the piston and the slip device in a second direction within the piston chamber and the slip device engages the sliding sleeve to move the sliding sleeve toward the second position.

B. A well system that includes a downhole completion positioned within a wellbore penetrating a subterranean formation, and a flow control assembly included in the downhole completion. The flow control assembly including a housing defining one or more flow ports that place an interior of the housing in fluid communication with a wellbore annulus, a sliding sleeve defining one or more sleeve ports and movably positioned within the interior between a first position, where fluid communication between the interior and the wellbore annulus via the one or more flow ports is prevented, and a second positon, where fluid communication between the interior and the wellbore annulus is facilitated through the one or more sleeve ports and the one or more flow ports, a piston movably arranged within a piston chamber defined between the housing and the sliding sleeve, the piston having a first end exposed to an interior pressure and a second end exposed to an annulus pressure via one or more chamber ports defined in the housing, a slip device movably arranged within the piston chamber, and a biasing device positioned within the piston chamber. Increasing the annulus pressure moves the piston and the slip device relative to the sliding sleeve in a first direction within the piston chamber to compress the biasing device. Overcoming the annulus pressure allows the biasing device to expand and move the piston and the slip device in a second direction within the piston chamber and the slip device engages the sliding sleeve to move the sliding sleeve toward the second position.

C. A method that includes increasing an annulus pressure within a wellbore annulus defined between a flow control assembly positioned within a wellbore and wall of the wellbore. The flow control assembly including a housing defining one or more flow ports that place an interior of the housing in fluid communication with the wellbore annulus, a sliding sleeve defining one or more sleeve ports and movably positioned within the interior between a first position, where fluid communication between the interior and the wellbore annulus via the one or more flow ports is prevented, and a second positon, where fluid communication between the interior and the wellbore annulus is facilitated through the one or more sleeve ports and the one or more flow ports, a piston arranged within a piston chamber defined between the housing and the sliding sleeve, the piston having a first end exposed to an interior pressure and a second end exposed to the annulus pressure via one or more chamber ports defined in the housing, a slip device movably arranged within the piston chamber, and a biasing device positioned within the piston chamber. The method further including moving the piston and the slip device relative to the sliding sleeve in a first direction within the piston chamber as the annulus pressure increases, compressing the biasing device as the piston and the slip device move in the first direction, overcoming the annulus pressure and thereby allowing the biasing device to expand and move the piston and the slip device in a second direction within the piston chamber, and engaging the sliding sleeve with the slip device and thereby moving the sliding sleeve toward the second position.

Each of embodiments A, B, and C may have one or more of the following additional elements in any combination: Element 1: further comprising a series of sleeve teeth defined on an outer surface of the sliding sleeve, and a series of slip teeth defined on an inner surface of the slip device and engageable with the sleeve teeth, wherein the slip teeth and the sleeve teeth are profiled to allow the slip device to ratchet over the sleeve teeth as the slip device moves in the first direction relative to the sliding sleeve, but prevent relative movement when the slip device moves in the second direction. Element 2: wherein the slip teeth and the sleeve teeth are further profiled to allow the sleeve teeth to ratchet over the slip teeth as the sliding sleeve moves in the second direction relative to the slip device, but prevent relative movement when the sliding sleeve moves in the first direction. Element 3: further comprising a wedge member positioned within the piston chamber, wherein the wedge member provides a wedge ramp and the slip member provides a slip ramp that slidingly engages the wedge ramp to radially expand the wedge member. Element 4: wherein the slip device is a C-ring. Element 5: wherein the slip device comprises a plurality of arcuate slip segments, and a retaining band positioned about an outer periphery of the plurality of slip segments.

Element 6: further comprising a shifting tool conveyable into the wellbore and engageable with a profile defined on an inner radial surface of the sliding sleeve, the shifting tool being operable to move the sliding sleeve in the first direction and toward the first position.

Element 7: wherein moving the piston and the slip device relative to the sliding sleeve in the first direction within the piston chamber comprises generating a pressure differential across the piston as the annulus pressure increases, and acting on the second end of the piston with the annulus pressure to thereby move the piston and the slip device in the first direction within the piston chamber. Element 8: wherein a series of sleeve teeth is defined on an outer surface of the sliding sleeve, and a series of slip teeth is defined on an inner surface of the slip device and engageable with the sleeve teeth, and wherein moving the piston and the slip device relative to the sliding sleeve in the first direction comprises ratcheting the slip teeth over the sleeve teeth as the slip device moves in the first direction relative to the sliding sleeve. Element 9: wherein engaging the sliding sleeve with the slip device comprises engaging an angled profile of the slip teeth against an angled profile of the sleeve teeth such that the sliding sleeve moves in the second direction with the slip device. Element 10: wherein the flow control assembly further comprises a wedge member positioned within the piston chamber, and wherein moving the piston and the slip device relative to the sliding sleeve in the first direction within the piston chamber comprises engaging a slip ramp provided on the slip device on a wedge ramp provided on the wedge member, and radially expanding the slip device as the slip ramp slidingly engages the wedge ramp. Element 11: wherein engaging the sliding sleeve with the slip device comprises slidingly disengaging the slip ramp from the wedge ramp as the slip device moves in the second direction, and radially contracting the slip device as the slip ramp disengages from the wedge ramp. Element 12: further comprising conveying a shifting tool into the wellbore and to the flow control assembly, engaging the shifting tool on a profile defined on an inner radial surface of the sliding sleeve, and moving the sliding sleeve in the first direction and toward the first position with the shifting tool Element 13: wherein a series of sleeve teeth is defined on an outer surface of the sliding sleeve, and a series of slip teeth is defined on an inner surface of the slip device and engageable with the sleeve teeth, and wherein moving the sliding sleeve in the first direction comprises engaging an angled profile of the slip teeth against an angled profile of the sleeve teeth such that the slip device moves in the first direction with the sliding sleeve. Element 15: wherein overcoming the annulus pressure comprises reducing the annulus pressure. Element 17: wherein overcoming the annulus pressure comprises increasing the interior pressure.

By way of non-limiting example; exemplary combinations applicable to A, B, and C include: Element 1 with Element 2; Element 8 with Element 9; Element 10 with Element 11; and Element 12 with Element 13.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A flow control assembly, comprising:

a housing defining one or more chamber ports that place an outer interior of the housing in fluid communication with a wellbore annulus and one or more flow ports that place an inner interior of the housing in fluid communication with the wellbore annulus;

a sliding sleeve defining one or more sleeve ports and movably positioned within the housing between a first position, where fluid communication between the inner interior and the wellbore annulus via the one or more flow ports is prevented, and a second positon, where fluid communication between the inner interior and the wellbore annulus is facilitated through the one or more sleeve ports and the one or more flow ports;

a piston movably arranged within a piston chamber defined between the housing and the sliding sleeve, the piston having a first end exposed to an inner interior pressure and a second end exposed to an annulus pressure via the one or more chamber ports defined in the housing when in the first position;

a slip device movably arranged within the piston chamber; and a biasing device positioned within the piston chamber, wherein increasing the exterior pressure moves the piston and the slip device relative to the sliding sleeve in a first direction within the piston chamber to compress the biasing device, and wherein overcoming the exterior pressure allows the biasing device to expand and move the piston and the slip device in a second direction within the piston chamber and the slip device engages the sliding sleeve to move the sliding sleeve toward the second position.

2. The flow control assembly of claim 1, further comprising:

a series of sleeve teeth defined on an outer surface of the sliding sleeve; and a series of slip teeth defined on an inner surface of the slip device and engageable with the sleeve teeth, wherein the slip teeth and the sleeve teeth are profiled to allow the slip device to ratchet over the sleeve teeth as the slip device moves in the first direction relative to the sliding sleeve, but prevent relative movement when the slip device moves in the second direction.

3. The flow control assembly of claim 2, wherein the slip teeth and the sleeve teeth are further profiled to allow the sleeve teeth to ratchet over the slip teeth as the sliding sleeve moves in the second direction relative to the slip device, but prevent relative movement when the sliding sleeve moves in the first direction.

4. The flow control assembly of claim 1, further comprising a wedge member positioned within the piston chamber, wherein the wedge member provides a wedge ramp and the slip member provides a slip ramp that slidingly engages the wedge ramp to radially expand the wedge member.

5. The flow control assembly of claim 1, wherein the slip device is a C-ring.

6. The flow control assembly of claim 1, wherein the slip device comprises:

a plurality of arcuate slip segments; and a retaining band positioned about an outer periphery of the plurality of slip segments.

7. A well system, comprising:

a downhole completion positioned within a wellbore penetrating a subterranean formation;

a flow control assembly included in the downhole completion and comprising:

a housing defining one or more chamber ports that place an outer interior of the housing in fluid communication with a wellbore annulus and one or more flow ports that place an inner interior of the housing in fluid communication with the wellbore annulus;

a sliding sleeve defining one or more sleeve ports and movably positioned within the housing between a first position, where fluid communication between the inner interior and the wellbore annulus via the one or more flow ports is prevented, and a second positon, where fluid communication between the inner interior and the wellbore annulus is facilitated through the one or more sleeve ports and the one or more flow ports;

a piston movably arranged within a piston chamber defined between the housing and the sliding sleeve, the piston having a first end exposed to an inner interior pressure and a second end exposed to an annulus pressure via the one or more chamber ports defined in the housing when in the first position;

a slip device movably arranged within the piston chamber; and a biasing device positioned within the piston chamber, wherein increasing the annulus pressure moves the piston and the slip device relative to the sliding sleeve in a first direction within the piston chamber to compress the biasing device, and wherein overcoming the annulus pressure allows the biasing device to expand and move the piston and the slip device in a second direction within the piston chamber and the slip device engages the sliding sleeve to move the sliding sleeve toward the second position.

8. The well system of claim 7, further comprising:

a series of sleeve teeth defined on an outer surface of the sliding sleeve; and a series of slip teeth defined on an inner surface of the slip device and engageable with the sleeve teeth, wherein the slip teeth and the sleeve teeth are profiled to allow the slip device to ratchet over the sleeve teeth as the slip device moves in the first direction relative to the sliding sleeve, but prevent relative movement when the slip device moves in the second direction.

9. The well system of claim 7, further comprising a wedge member positioned within the piston chamber, wherein the wedge member provides a wedge ramp and the slip member provides a slip ramp that slidingly engages the wedge ramp to radially expand the wedge member.

10. The well system of claim 7, further comprising a shifting tool conveyable into the wellbore and engageable with a profile defined on an inner radial surface of the sliding sleeve, the shifting tool being operable to move the sliding sleeve in the first direction and toward the first position.

11. A method, comprising:

increasing an annulus pressure within a wellbore annulus defined between a flow control assembly positioned within a wellbore and wall of the wellbore, the flow control assembly comprising:

a housing defining one or more chamber ports that place an outer interior of the housing in fluid communication with a wellbore annulus and one or more flow ports that place an inner interior of the housing in fluid communication with the wellbore annulus;

a sliding sleeve defining one or more sleeve ports and movably positioned within the housing between a first position, where fluid communication between the inner interior and the wellbore annulus via the one or more flow ports is prevented, and a second positon, where fluid communication between the inner interior and the wellbore annulus is facilitated through the one or more sleeve ports and the one or more flow ports;

a piston movably arranged within a piston chamber defined between the housing and the sliding sleeve, the piston having a first end exposed to an inner interior pressure and a second end exposed to an annulus pressure via the one or more chamber ports defined in the housing when in the first position;

a slip device movably arranged within the piston chamber; and a biasing device positioned within the piston chamber;

moving the piston and the slip device relative to the sliding sleeve in a first direction within the piston chamber as the annulus pressure increases;

compressing the biasing device as the piston and the slip device move in the first direction;

overcoming the annulus pressure and thereby allowing the biasing device to expand and move the piston and the slip device in a second direction within the piston chamber; and engaging the sliding sleeve with the slip device and thereby moving the sliding sleeve toward the second position.

12. The method of claim 11, wherein moving the piston and the slip device relative to the sliding sleeve in the first direction within the piston chamber comprises:

generating a pressure differential across the piston as the annulus pressure increases; and acting on the second end of the piston with the annulus pressure to thereby move the piston and the slip device in the first direction within the piston chamber.

13. The method of claim 11, wherein a series of sleeve teeth is defined on an outer surface of the sliding sleeve, and a series of slip teeth is defined on an inner surface of the slip device and engageable with the sleeve teeth, and wherein moving the piston and the slip device relative to the sliding sleeve in the first direction comprises ratcheting the slip teeth over the sleeve teeth as the slip device moves in the first direction relative to the sliding sleeve.

14. The method of claim 13, wherein engaging the sliding sleeve with the slip device comprises engaging an angled profile of the slip teeth against an angled profile of the sleeve teeth such that the sliding sleeve moves in the second direction with the slip device.

15. The method of claim 11, wherein the flow control assembly further comprises a wedge member positioned within the piston chamber, and wherein moving the piston and the slip device relative to the sliding sleeve in the first direction within the piston chamber comprises:

engaging a slip ramp provided on the slip device on a wedge ramp provided on the wedge member; and radially expanding the slip device as the slip ramp slidingly engages the wedge ramp.

16. The method of claim 15, wherein engaging the sliding sleeve with the slip device comprises:

slidingly disengaging the slip ramp from the wedge ramp as the slip device moves in the second direction; and radially contracting the slip device as the slip ramp disengages from the wedge ramp.

17. The method of claim 11, further comprising:

conveying a shifting tool into the wellbore and to the flow control assembly;

engaging the shifting tool on a profile defined on an inner radial surface of the sliding sleeve; and moving the sliding sleeve in the first direction and toward the first position with the shifting tool.

18. The method of claim 17, wherein a series of sleeve teeth is defined on an outer surface of the sliding sleeve, and a series of slip teeth is defined on an inner surface of the slip device and engageable with the sleeve teeth, and wherein moving the sliding sleeve in the first direction comprises engaging an angled profile of the slip teeth against an angled profile of the sleeve teeth such that the slip device moves in the first direction with the sliding sleeve.

19. The method of claim 11, wherein overcoming the annulus pressure comprises reducing the annulus pressure.

20. The method of claim 11, wherein overcoming the annulus pressure comprises increasing the interior pressure.

* * * * *